US005800902A

United States Patent [19]

Shimmell et al.

[11] Patent Number: 5,800,902

[45] Date of Patent: Sep. 1, 1998

[54] METAL DIE CAST ARTICLE WITH REINFORCING INSERT

[75] Inventors: Dennis S. Shimmell, Hudsonville; Samir Mesanovic, Kentwood, both of Mich.

[73] Assignee: Nelson Metal Products Corporation, Grandville, Mich.

[21] Appl. No.: 404,619

[22] Filed: Mar. 15, 1995

[51] Int. Cl.[6] ..... B22D 19/02

[52] U.S. Cl. ..... 428/139; 428/586; 428/594; 428/595; 428/596; 428/597; 428/598; 428/603; 428/614; 428/138; 428/161; 428/164; 123/198 P; 164/98; 164/108; 164/111; 164/109; 164/110; 29/888.01

[58] Field of Search ..... 428/586, 594, 428/595, 596, 597, 598, 603, 614, 138, 139, 161, 164; 123/198 P; 164/98, 108, 111, 109, 110; 29/888.01

[56] References Cited

U.S. PATENT DOCUMENTS

| | | | |
|---|---|---|---|
| 168,408 | 1/1875 | Onions | 428/614 |
| 1,065,733 | 6/1913 | Schuppener | 428/592 |
| 1,716,833 | 6/1929 | Rich | 164/99 |
| 2,205,006 | 6/1940 | Eccles | 164/95 |
| 2,256,000 | 9/1941 | McNeil | 164/108 |
| 2,274,667 | 3/1942 | Colwell | 123/188.3 |
| 2,482,841 | 9/1949 | Cooper | 164/108 |
| 3,191,252 | 6/1965 | Webbere | 164/111 |
| 3,410,606 | 11/1968 | Benton et al. | 301/65 |
| 3,947,029 | 3/1976 | Gallagher | 164/112 |
| 4,105,067 | 8/1978 | Bovagne | 428/594 |
| 4,266,596 | 5/1981 | Ban et al. | 164/97 |
| 4,491,168 | 1/1985 | Snee | 164/98 |
| 4,908,923 | 3/1990 | Anderson et al. | 29/888.01 |
| 5,168,964 | 12/1992 | Shimmell | 29/890.12 |
| 5,313,703 | 5/1994 | Shimmell | 188/72.4 |

FOREIGN PATENT DOCUMENTS

| | | |
|---|---|---|
| 0052818 | 2/1982 | European Pat. Off. . |
| 364226 | 11/1922 | Germany . |

OTHER PUBLICATIONS

Patent Abstracts of Japan vol. 014, No. 399 (M-1017) 29 Aug. 1990 & JP-A-21 51 363 (Mitsubishi Motors Corp) 11 Jun. 1990.

*Primary Examiner*—William Watkins
*Attorney, Agent, or Firm*—Warner Norcross & Judd

[57] ABSTRACT

A stamped, steel insert for use in metal die cast articles. The insert includes first and second interconnected stamped steel insert halves spaced from one another at certain locations to define a void. Openings communicating with the void extend through each insert half to facilitate material flow and to improve interlock of the insert and die cast material. The edges of the insert lie below the surface of the casting to avoid bimetallic machining. The insert halves cooperate to define a pair of elongated passages, which are bored following die casting to form fastener holes. At least one of the passages has an elongated cross section to allow for expansion and contraction of the insert during casting.

18 Claims, 3 Drawing Sheets

METAL DIE CAST ARTICLE WITH REINFORCING INSERT

BACKGROUND OF THE INVENTION

The present invention relates to an insert for use in die casting, and more particularly, to a stamped steel insert for use in die casting.

Die casting is frequently used as a method for forming articles from molten material, such as metals or polymers. Typically, the die casting apparatus includes a pair of die halves each formed with a void corresponding to a portion of the article to be cast. When the two die halves are brought together in proper alignment, their respective voids cooperate to form a die cavity corresponding to the shape of the article to be cast. Molten material is introduced into the die and allowed to cure—typically by cooling the molten material to allow it to solidify. Once the material is sufficiently cured, the die halves are opened and the cast article is removed.

As a result of the weight concerns associated with machined steel and cast iron parts, there is an ever increasing demand for die cast articles formed from lighter weight metals such as aluminum and aluminum alloys. These metals, however, do not have sufficient strength and wear characteristics desired for many applications.

In an effort to balance weight and strength, prior artisans have included reinforcing inserts in the die cast articles. Such inserts can be fabricated of such materials as cast iron, machined steel, or precast aluminum. The inserts are placed in the die cavity prior to casting so that they are surrounded by molten material during casting to become an integral part of the article after curing. The inserts are generally located at high stress and high wear locations. For example, inserts may be located at high stress portions of an aluminum casting to withstand forces that would otherwise fatigue aluminum. Also, inserts may be positioned at locations where the aluminum casting will contact another part to prevent coining or wear of the casting.

Die cast articles are often machined after curing to shape the article to meet precise specifications. For example, contact surfaces may be planed or bearing seats may be rounded. In addition, articles cast with inserts may require a certain amount of additional machining to compensate for expansion or contraction or shifting of the insert during the casting process. Because the insert is trapped within the body of the article, bimetallic machining, or the simultaneous machining of two different metals, is often necessary. Bimetallic machining can be difficult and is a significant draw-back to the use of inserts. When two metals of different physical characteristics are machined simultaneously, special methods are required. This increases the cost of manufacturing the article.

As noted above, inserts are typically formed from machined steel, cast iron, or precast aluminum. Inserts formed from these materials are relatively expensive. In addition, both machined steel and cast iron inserts are relatively heavy.

SUMMARY OF THE INVENTION

The present invention overcomes the aforementioned problems by providing a stamped steel insert having interconnected stamped steel insert portions. The insert portions are spaced apart allowing molten material to flow between and around the insert portions during casting.

The two insert portions are contoured to define one or more voids when the portions are interconnected. For example, the voids may define passages for elongated fasteners. A number of openings are formed through the insert halves to allow molten material to flow between the insert halves during casting. The openings reduce the weight of the insert and provide additional interlock between the insert and casting.

The insert can be recessed from the surface of the casting because cast material in the spaced-apart portion strengthens and supports the thin layer of cast material between the edge of the insert and the surface of the casting.

Optionally, support tabs extend across the spaced-apart portions of the insert. The support tabs increase the strength of the insert. Alternatively, the insert includes a number of separate stamped insert portions that are sandwiched between top and bottom support strips. The support strips allow the insert portions to be spaced from one another to accommodate the passageway of relatively large diameter bolts or fasteners through relatively narrow walls. Optionally, a stamped steel plate may be secured in the internal void to strengthen the insert.

The present invention provides an effective, low cost, light-weight insert for use in die casting. Cast material filling the openings and the void increases the interlock between the insert and the casting. Further, the present invention permits the full encapsulation of the insert to reduce, or even eliminate, bimetallic machining.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
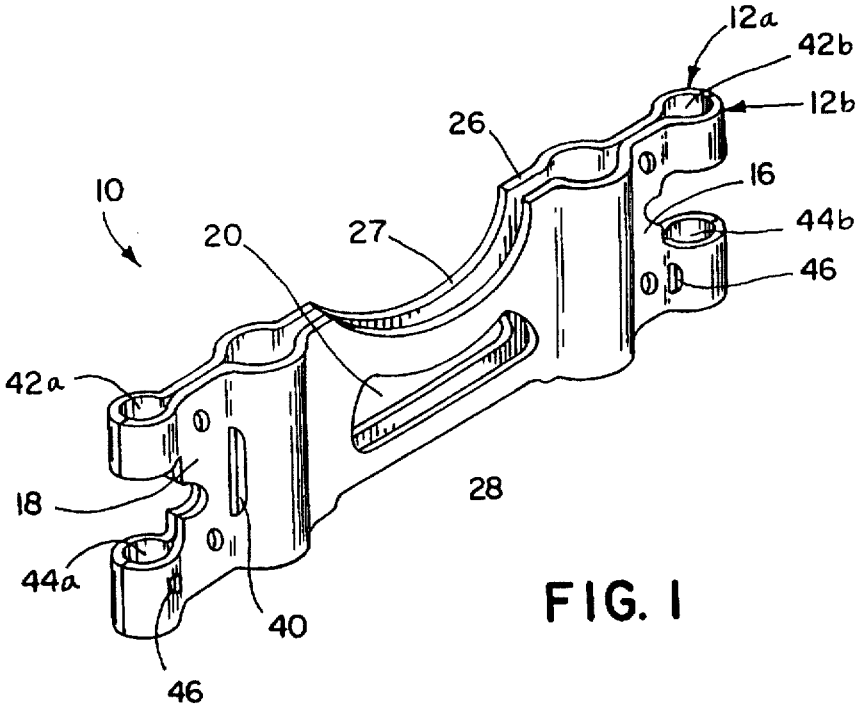
FIG. 1 is a perspective view of the stamped steel insert.

A stamped steel insert according to a preferred embodiment of the present invention is shown in FIG. 1, and generally designated 10. For purposes of disclosure, the present invention will be described in conjunction with an insert for a lower crankcase housing of an automobile engine. However, the present invention is equally well suited for use with other die cast articles.

Figure 2:
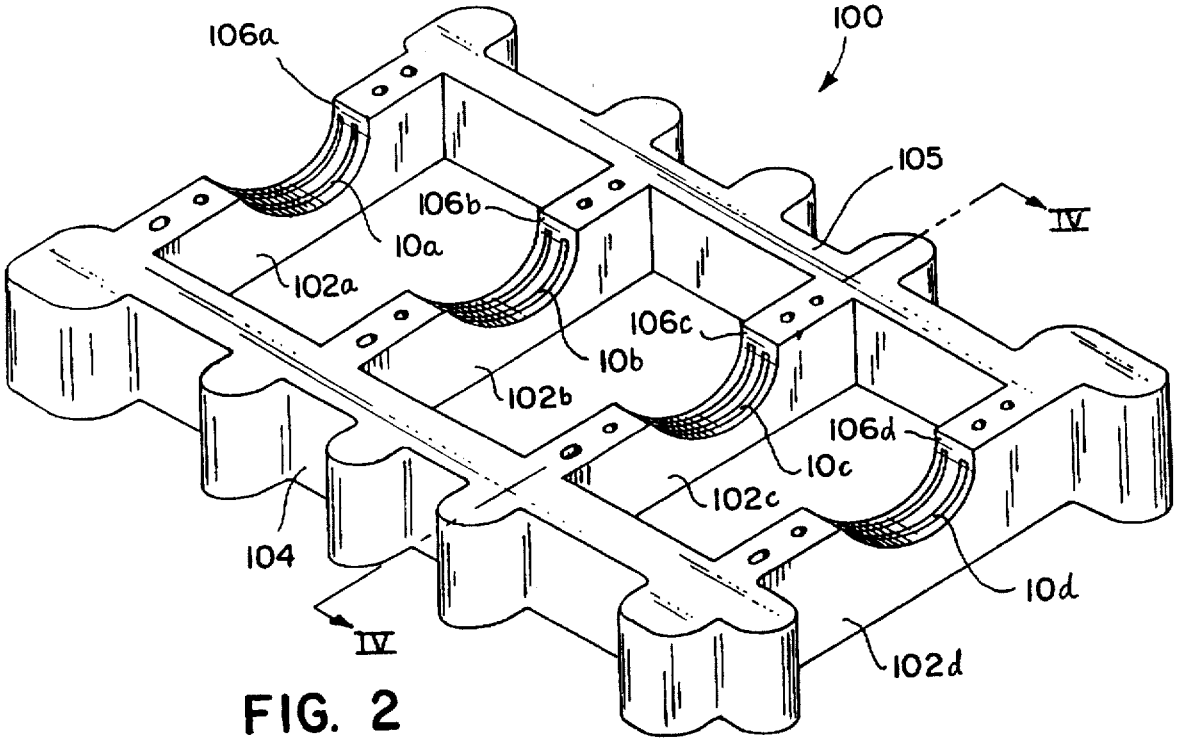
FIG. 2 is a perspective view of an engine block lower crank case including the inserts.

FIG. 2 shows a lower crankcase housing 100 for use with a six-cylinder internal combustion engine (not shown). The lower crankcase housing 100 mounts to the undersurface of the engine to support the cam shaft (not shown) and bolster the engine against vibration. The housing 100 includes four lateral support walls 102*a–d* extending between a pair of longitudinal side walls 104 and 105. A bearing seat 106*a–d* is formed in each of the support walls 102*a–d* to seat a bearing assembly (not shown) for rotatably supporting the cam shaft. The compression forces acting on the support walls are sufficient to fatigue aluminum over time. As a result, each of the support walls 102*a–d* are bolstered by an insert 10*a–d* that is placed in the die cavity during casting of the housing 100. The molten material injected into the die cavity surrounds the inserts 10*a–d* so that they become an integral part of the housing 100. Once the casting has sufficiently cured, the housing 100 is machined to precise specifications by known techniques.

Referring now to FIG. 1, the insert 10 includes first and second insert halves or portions 12*a* and 12*b* that are interconnected or adjoined along mating portions 16 and 18. Preferably, the two insert halves are interconnected by welding. In a preferred embodiment, the two insert halves 12*a* and 12*b* are generally identical to one another. This reduces the manufacturing costs of the insert because only a single stamp or die is necessary. However, the insert halves may be shaped differently when necessary.

Figure 3:
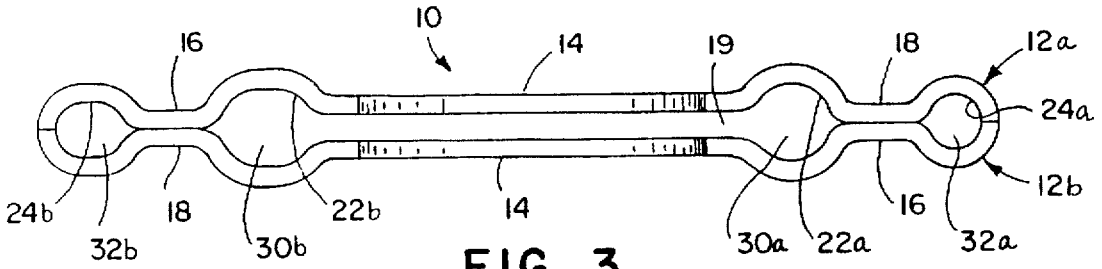
FIG. 3 is a top plan view of an insert.
Figure 4:
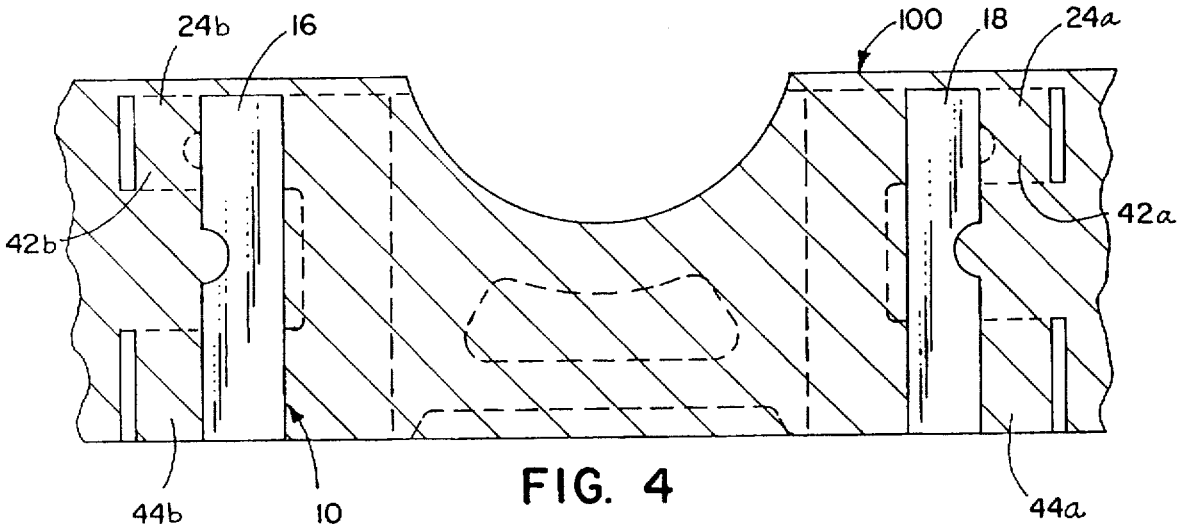
FIG. 4 is a sectional view of a portion of the engine block lower crank case drawn along line IV—IV of FIG. 2.

Referring also to FIGS. 3 and 4, the insert half 12 is preferably a stamped steel component including a substantially planar central portion 14 extending between a pair of substantially planar end portions 16 and 18. End portions 16, 18 extend along a single common plane which is parallel to and offset from the plane defined by central portion 14. Consequently, an internal void 19 is formed between the insert halves when the corresponding end portions are brought into mating alignment. The central portion includes opposite longitudinal edges 26, 28. A recess 28 is formed in longitudinal edge 28 and an arcuate notch 27 dimensioned to follow the curvature of the bearing seat is formed in longitudinal edge 26. As illustrated in FIG. 4, notch 27 preferably co-extends with the surface of the casting. However, notch 27 may be recessed below the surface of the casting to reduce bimetallic machining when desired. Further, a single opening 20 is formed through central portion 14 to allow molten material to flow freely therethrough. The precise number and configuration of openings formed in the central portion may vary from application to application depending in part on both the shape of the insert and the characteristics of the molten material.

As perhaps best illustrated in FIG. 3, each insert half 12 also includes two pairs of troughs 22*a–b*, 24*a–b* located along opposite lateral edges of the end portions 16. The troughs 22*a–b*, 24*a–b* of each insert half cooperate with one another to define two pairs of passages 30*a–b*, 32*a–b*. The die cast material within the passages may be removed to define holes for receiving bolts or other fasteners through the insert 10. Preferably, at least one passage from each pair of passages 30*a–b*, 32*a–b* has an elongated (e.g. elliptical) cross section to allow for expansion and contraction of the insert during casting. Troughs 22*a–b* extend across the entire lateral extent of the insert half 12 and include an opening 40 to allow molten material to fill the passage 30*a–b* during casting. Troughs 24*a–b* are comprised of spaced-apart top and bottom portions 42*a–b*, 44*a–b*. An opening 46 is formed through each of the upper portions 42*a–b* to allow molten material to fill the passage 32*a–b* during casting. Alternatively, troughs 24*a–b* can extend across the entire lateral extent of the insert half 12, and openings may be formed through the troughs 24*a–b* to allow metal to fill the passage 32*a–b* during casting.

Figure 5:
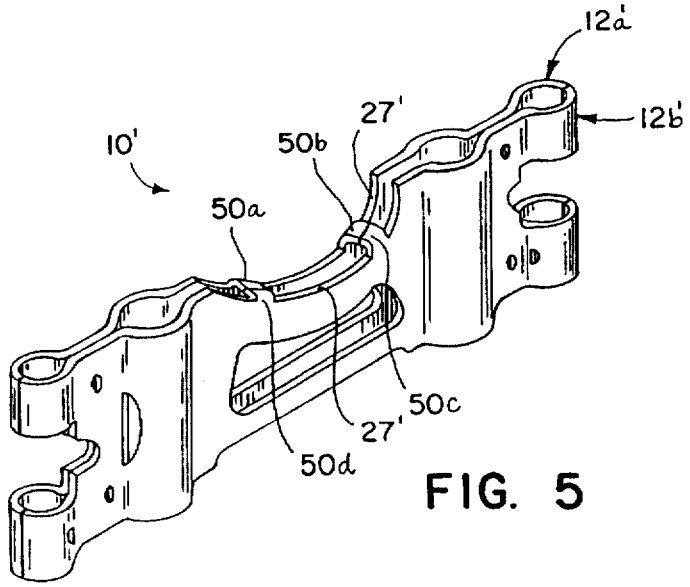
FIG. 5 is a perspective view of an insert according to a first alternative embodiment.

In a first alternative embodiment (FIG. 5), an insert 10' otherwise identical to the preferred embodiment described above is formed with support tabs 50*a–d* that strengthen the insert and bolster the casting against forces applied in a direction parallel to the extent of the insert. For example, in a six cylinder engine, combustion within the cylinders exerts a force on the various bearing seat at 60° intervals. By locating the support tabs 50*a–d* at 60° intervals along arcuate notch 27', the casting is bolstered against the combustion forces. Preferably, tabs 50*a–d* are stamped as an integral part of insert halves 12*a'–b'*.

Figure 6:
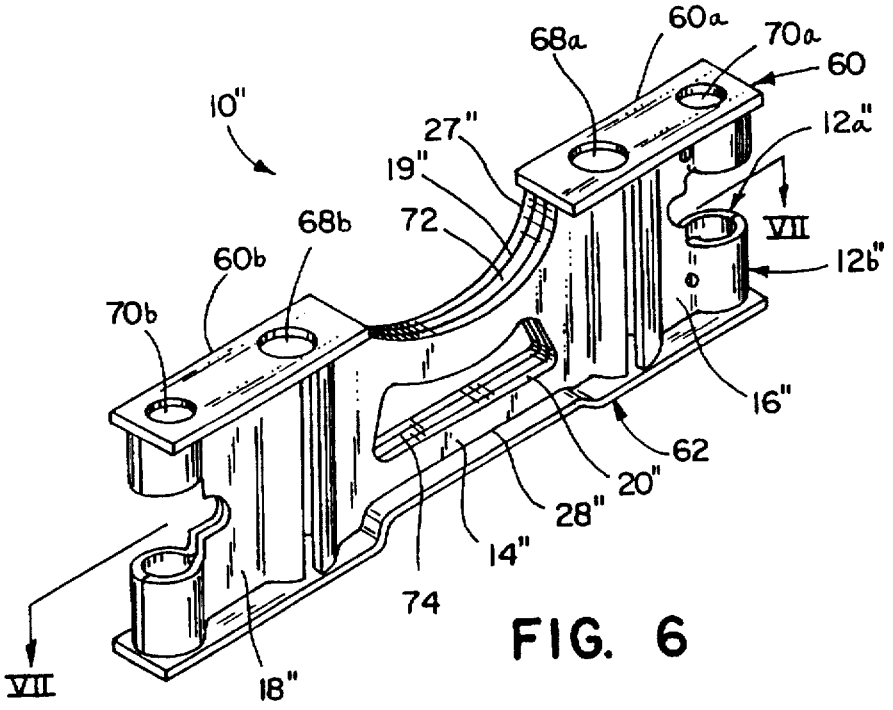
FIG. 6 is a perspective view of an insert according to a second alternative embodiment.
Figure 7:
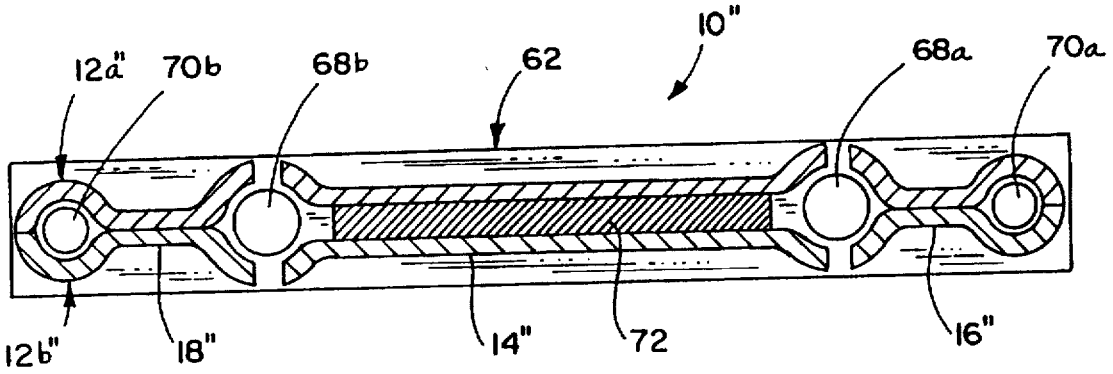
FIG. 7 is a sectional view of an insert taken along line VII—VII in FIG. 6.

In a second alternative embodiment (FIGS. 6–7), each insert half 12*a"* or 12*b"* includes central portion 14" and end portions 16", 18" that are adjoined by top and bottom support strips 60, 62 (See FIGS. 6 and 7). As perhaps best illustrated in FIG. 7, the insert halves 12*a"–b"* are generally similar to those of the preferred embodiment. However, a central portion of troughs 22*a–"b"* are eliminated so that end portions 16", 18" are spaced apart from central portion 14".

The top and bottom support strips 60, 62 are preferably metal strips welded along the top and bottom edges of the insert 10". Top support strip 60 preferably includes two separate portions 60*a–b* that terminate at opposite ends of notch 27". Optionally, the top strip can extend across the entire top edge of the insert following the contour of notch 27". Bottom support strip 60 is a preferably a single metal strip that extends across the entire bottom of the insert following the contour of recess 28".

As illustrated in FIG. 6, the top support strip 60 defines holes 68*a–b* and 70*a–b* to receive bolts or other fasteners. While hidden from view in FIG. 6, corresponding holes are formed through bottom strip 62.

Optionally, a generally planar support plate 72 (FIG. 7) is secured within internal void 19" to strengthen the insert and bolster the casting against forces applied in a direction parallel to the extent of the insert. Support plate 72 is preferably a metal plate of sufficient thickness to fill void 19". An opening 74 can be formed through the support plate 72 in correspondence with the opening 20" in central portion 14". Support plate 72 is preferably welded to both insert halves 12*a–b"*.

The above description are those of preferred embodiments of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A metal die cast article comprising:

die cast metal;

an insert contained in said metal and including a first stamped metal piece and a second stamped metal piece fixedly interconnected to said first insert piece, said insert pieces defining a void and a passage therebetween, said die cast metal being absent from said passage thereby allowing a fastener to extend through said article between said pieces.

2. The article of claim 1 wherein at least one of said first and said second pieces defines an aperture communicating with said void, whereby molten metal material may flow into said void during die casting.

3. The article of claim 2 wherein said first and said second pieces together define a second elongated passage substantially parallel to said first passage, said second passage having an elongated cross section.

4. The article of claim 2 wherein each of said pieces includes a central portion and a pair of end portions separate from and spaced from said central portion, said central portions being spaced-apart to define said void, said end portions being interconnected to inter secure said pieces.

5. The article of claim 4 further comprising a support strip fixedly interconnected to said central portion and said end portions of each of said insert halves.

6. The article of claim 4 further comprising a reinforcing member sandwiched between said pieces within said void.

7. The article of claim 2 wherein at least one of said pieces includes a support tab extending from said one piece and engaging the other of said pieces.

8. A die cast article comprising:

die cast metal material;

an insert enveloped by said material, said insert including first and second stamped metal members, said members fixedly intersecured and each including a spaced-apart portion spaced from the spaced-apart portion of the other member defining a space therebetween, said cast material extending into said space, said members further defining a passage therebetween, said cast material being absent from said passage thereby allowing a fastener to extend through said article between said members.

9. The article of claim 8 wherein at least one of said members defines an opening communicating with said space, said material extending said through said opening and into said space.

10. A die cast metal article comprising:

die cast material;

an insert enveloped by said material, said insert including first and second stamped metal members, said members fixedly intersecured and each including a spaced-apart portion spaced from the spaced-apart portion of the other member defining a space therebetween, said cast material extending into said space, at least one of said members defining an opening communicating with said space, said material extending through said opening and into said space, said members together defining a first elongated passage; and where in a portion of said die cast material has been removed from said first passage, whereby a fastener may be received within said first passage.

11. The article of claim 10 wherein:

said members together define a second elongated passage substantially parallel to said first passage, said second passage having an elongated cross section; and a portion of said die cast material has been removed from said second passage, whereby a fastener may be received within said second passage.

12. The article of claim 1 wherein;

said die cast material has a surface; and said insert is flush with said surface, whereby said insert and said body cooperate to define a surface profile of said article.

13. The article of claim 12 wherein said insert includes a longitudinal edge recessed below said surface.

14. The article of claim 13 wherein at least one of said members includes a support tab extending across said space and engaging the other of said members.

15. A metal die cast article comprising:

die cast metal;

an insert contained in said metal, said insert including first and second interconnected stamped steel insert halves, each of said insert halves including first and second edges and first and second portions separated from one another, said insert further including a first support strip extending along said first edges of said insert halves and a second support strip extending along said second edge of said insert halves, said first and second portions of each of said insert halves being fixedly interconnected by said support strips.

16. The article of claim 15 wherein each of said insert halves includes a mating portion at which said insert halves mate with one another and a spaced-apart portion at which said insert halves are spaced-apart from one another; and a support plate affixed between said insert halves at said spaced-apart portions.

17. A metal die cast article, comprising:

die cast metal;

an insert contained in said die cast metal, said insert including first and second interconnected stamped steel insert halves each having a mating portion and a spaced-apart portion, said mating portions fixedly intersecured, said spaced-apart portions defining a void therebetween, said metal extending into said void; said insert further including a plurality of support tabs integrally formed with said first and second insert halves, said support tabs on each of said halves extending across said void and engaging said support tabs on the other half.

18. A metal die cast article comprising:

die cast metal having a surface;

an insert contained within said die cast metal, said insert including first and second stamped metal members interconnected to one another, said members defining a void therebetween, said die cast material extending into said void, at least one of said members including an edge co-extensive with said surface of said die cast metal.

* * * * *

UNITED STATES PATENT AND TRADEMARK OFFICE

CERTIFICATE OF CORRECTION

PATENT NO. : 5,800,902

DATED : September 1, 1998

INVENTOR(S) : Shimmell et al.

It is certified that error appears in the above-indentified patent and that said Letters Patent is hereby corrected as shown below:

Column 5, Claim 12, line 45:
"1" should be --11--

Signed and Sealed this

Seventh Day of September, 1999

*Attest:*

Q. TODD DICKINSON

*Attesting Officer*

*Acting Commissioner of Patents and Trademarks*